US006786807B2

(12) United States Patent
Becksvoort et al.

(10) Patent No.: US 6,786,807 B2
(45) Date of Patent: Sep. 7, 2004

(54) UNIVERSAL COUPLING FOR MACHINE TOOL

(75) Inventors: Mark Lee Becksvoort, Hamilton, MI (US); Benjamin Muril Sipe, Geneva, IN (US)

(73) Assignee: Micromatic Operations, Inc., Holland, MI (US)

( * ) Notice: Subject to any disclaimer, the term of this patent is extended or adjusted under 35 U.S.C. 154(b) by 8 days.

(21) Appl. No.: 10/277,291

(22) Filed: Oct. 22, 2002

(65) Prior Publication Data

US 2004/0043712 A1 Mar. 4, 2004

Related U.S. Application Data

(60) Provisional application No. 60/407,894, filed on Sep. 3, 2002.

(51) Int. Cl.[7] ..... B24B 5/40

(52) U.S. Cl. ..... 451/155; 451/51; 451/61; 51/330

(58) Field of Search ..... 451/51, 61, 58, 451/124, 155, 164, 168, 462, 464, 470, 481, 504, 505; 51/330, 204, 338, 340, 355, 339

(56) References Cited

U.S. PATENT DOCUMENTS

| | | | | |
|---|---|---|---|---|
| 1,121,144 A | * | 12/1914 | Sponsel | 464/134 |
| 2,787,865 A | | 4/1957 | Gross | 51/34 |
| 2,876,636 A | * | 3/1959 | Thackeray | 464/14 |
| 3,626,437 A | * | 12/1971 | Staples | 451/470 |
| 4,065,881 A | | 1/1978 | Gillette | 51/346 |
| 4,075,794 A | | 2/1978 | Blaylock | 51/340 |
| 4,094,103 A | | 6/1978 | Ebelt | 51/34 |
| 4,371,359 A | | 2/1983 | Brennan | 464/136 |
| 4,483,755 A | | 11/1984 | Heck et al. | 204/129.1 |
| 4,551,947 A | | 11/1985 | Grimm et al. | 51/34 |
| 4,655,007 A | * | 4/1987 | Graft et al. | 451/478 |
| 4,683,680 A | | 8/1987 | Bender | 51/34 |
| 4,893,962 A | * | 1/1990 | Komeyama | 403/288 |
| 5,050,352 A | * | 9/1991 | Estabrook et al. | 451/463 |
| 5,371,978 A | | 12/1994 | Higashikawa | 451/51 |
| 5,482,498 A | | 1/1996 | Higashikawa | 451/61 |
| 5,800,252 A | * | 9/1998 | Hyatt | 451/61 |
| 5,957,766 A | | 9/1999 | Kalokhe et al. | 451/470 |
| 6,425,808 B1 | * | 7/2002 | Higashikawa | 451/180 |

* cited by examiner

*Primary Examiner*—Lee D. Wilson
*Assistant Examiner*—Anthony Ojini
(74) *Attorney, Agent, or Firm*—Perman & Green, LLP

(57) ABSTRACT

A detachable tool body is connected to the mandrel by means of a universal type coupling. The mating end of the drive shaft is constructed with U-shaped element having a pair of arms extending axially towards the tool body. The inner surfaces of the arms form a partially cylindrical seat. A similar U-shaped element having a pair of similar arms is constructed on the tool body with basically a mirror image profile relative to the drive shaft element. In the assembled position the mated arms define an inner bearing chamber (seat) having dual cylindrical surfaces with transverse axes. A barrel is constructed, which is shaped to nest in the seat formed by the mated pair of U-shaped elements and acts as a bearing which allows dual axes of motion. The adjustment rod of the abrasive element adjustment mechanism extends from the drive shaft through a bore in the barrel and into the tool body.

8 Claims, 6 Drawing Sheets

UNIVERSAL COUPLING FOR MACHINE TOOL

RELATED APPLICATIONS

This application claims the benefit of Provisional Application Serial No. 60/407,894, filed Sep. 3, 2002.

BACKGROUND OF THE INVENTION

1. Field of the Invention

The present invention relates to a coupling between the drive shaft of a honing machine and a tool body which supports abrasive elements. The coupling provides universal movement of the tool body on the drive shaft while allowing the passage of the abrasive element adjustment rod from the drive shaft to the adjustment cones. This is accomplished without using the pins typical of the prior art.

2. Brief Description of Related Developments

Machines for boring and finishing cylindrical holes, such as engine cylinder bores, use a tool having abrasive strips mounted on a cylindrical body. As these tools wear, they are generally adjusted radially outward to compensate for the depletion of the abrasive surface. The wear compensating adjustment mechanism forms part of the tool body and comes in many shapes and sizes, for example the tool shown and described in U.S. Pat. No. 4,075,794. These tools consist of a mandrel which connects to the machine spindle at one end and is constructed with an abrasive head at the other. A connecting rod connects to an adjustment mechanism within the abrasive head to bias the abrasive elements radially outward against the work piece. The adjustment can be accomplished automatically as shown in the '794 patent or manually as shown in the reference Gross, U.S. Pat. No. 2,787,865.

The particular tools, shown in the above referenced patents, are used in honing machines for the construction of bores, such as piston cylinders in automotive engines and similar applications. In the past, such machines have been dedicated to specific tasks in association with particular production runs. With the onset of modern manufacturing concepts such as Just in Time Manufacturing, lean manufacturing, and other inventory reduction methods, there is a need to apply flexible machining systems to the tasks that were previously performed by dedicated machinery. Flexible machine systems generally employ computer numerically controlled (CNC) equipment capable of performing multiple varied operations on multiple workpieces. It is a purpose of this invention to provide a honing tool which facilitates use with CNC machinery.

In order to increase the flexibility of a tool assembly for use in CNC machines, it becomes advantageous to be able to replace the tool body without dismantling the entire tool, which may cause considerable down time. It is a purpose of this invention to facilitate the removal of the tool body from the mandrel so as to allow the replacement of the abrasive elements. A tool having an abrasive head (tool body) which is removable from the mandrel is described in U.S. Pat. No. 5,957,766, which issued on Sep. 28, 1999 to an assignee common to this application. The disclosure of the '766 patent is incorporated herein by reference.

It is also advantageous to provide a coupling for the tool body to the drive shaft of the machine which allows a universal type of relative movement. Prior art attempts to provide a universal tool mounting typically provided movement about a pair of mutually transverse axes. This was accomplished by constructing matius U-shaped ears on the interface surfaces of the tool body and mandrel. The respective pairs of ears are mated by rotating the tool body ninety degrees from the axially aligned mandrel. Pins are inserted though aligned bores which extend through the ears and the opposing part. Couplings of this type are shown in U.S. Pat. Nos. 4,371,359 and 4,065,881. It is observed that these couplings become complex when provision is made for the passage of the adjustment rod.

It is a purpose of this invention to construct a universal type coupling in which the pins are eliminated, thereby simplifying the manufacture of the tools and mandrels.

It is a purpose of this invention to simplify the coupling of the drive shaft to the tool body while providing a conveniently detachable mechanism which allows for removal of the tool head. It is a purpose of this invention to provide for convenient extension of the adjustment rod through the coupling and for releasably connecting the adjustment rod to the adjustment mechanism. It is another purpose of the invention to strength the coupling by eliminating the pins to provide a stronger structure for the transmission of torque.

SUMMARY OF THE INVENTION

A tool is constructed for a CNC machine station to perform a honing operation as part of a flexible machining system. The tool is an assembly of a tool body which holds the abrasive elements, a mandrel which supports the tool body, and a coupling which connects the tool to the CNC machine, as is well known. Commonly the abrasive elements are positioned in axially extending slots positioned circumferentially about the periphery of the tool body. The abrasive elements engage a cone shaped cam that is designed to convert an axial force into a radial force to move the abrasive elements radially. The abrasive elements are spring biased radially inward to provide both extension and retraction of the abrasive elements. The radial force is generally exerted by the motion of a rod extending axially through the mandrel to engage the cam surfaces.

The tool of this invention has a detachable tool body which is connected to the mandrel by means of a universal type coupling. The coupling is designed to allow the passage of the abrasive element adjustment rod.

In the coupling of this invention, the adjacent ends of the mandrel or drive shaft and the tool body are constructed for axial alignment in the assembled position. An axially extending bore is constructed and extends from the drive shaft to tool body to accommodate the passage of an adjustment rod in the assembled position. The mating end of the drive shaft is constructed with U-shaped element having a pair of arms 180 degrees apart extending axially towards the tool body. The inner surfaces of the arms form a partially cylindrical seat. A similar U-shaped element having a pair of similar arms is constructed on the mating interface of the tool body with basically a mirror image profile relative to the drive shaft. The tool body is rotated ninety degrees to mate with the drive shaft. In the assembled position the mated arms define an inner bearing chamber (seat) having dual cylindrical surfaces with transverse axes.

In order to hold the tool body in rotatable engagement with the drive shaft, a barrel is constructed, which is shaped to nest in the seat formed by the mated pair of U-shaped elements. To assemble the tool body on the drive shaft, the barrel is nested within the partial cylindrical seat of the U-shaped element in the drive shaft. The tool body may now be mounted on the drive shaft by displacing the tool body sideways, i.e. transverse to the axis of the tool, and sliding the tool body U-shaped element over the drive shaft U-shaped element. The barrel engages the seat formed by the drive shaft/tool body interface and acts as a bearing which allows dual axes of motion.

The adjustment rod of the abrasive element adjustment mechanism extends from the drive shaft through a bore in the barrel and into the tool body. A transverse slot is constructed in the tool body which connects with the adjustment rod bore. The adjustment rod ends in a spherical portion integral with the rod and connected thereto by means of a neck portion of reduced diameter. The adjustment cone of the adjustment mechanism is constructed with a key shaped slot to allow the engagement of the adjustment rod in the adjustment cone in the same motion that occurs as the tool body is mounted on the drive shaft.

An assembly sleeve is mounted for axial movement on the drive shaft and is slid downward over the coupling to complete the assembly.

BRIEF DESCRIPTION OF THE DRAWINGS

The coupling of this invention is explained in more detail below with reference to the accompanying drawing, in which.

DESCRIPTION OF THE PREFERRED EMBODIMENT

Figure 1:
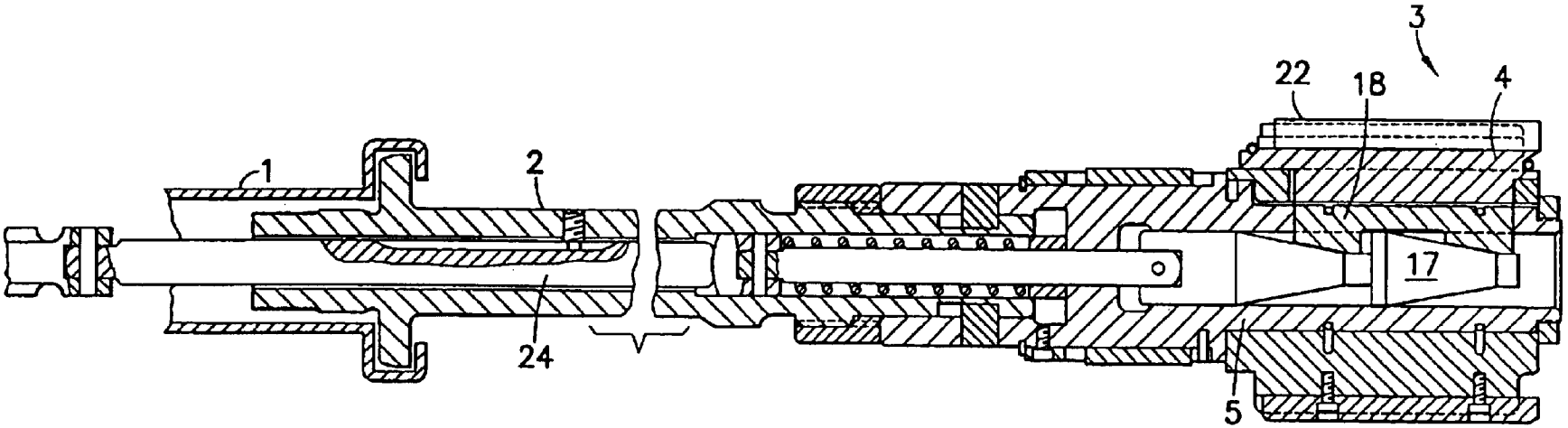
FIG.1 PRIOR ART
FIG. 1 is a cut away view of the entire tool assembly from tip to spindle of the prior art.
Figure 2:
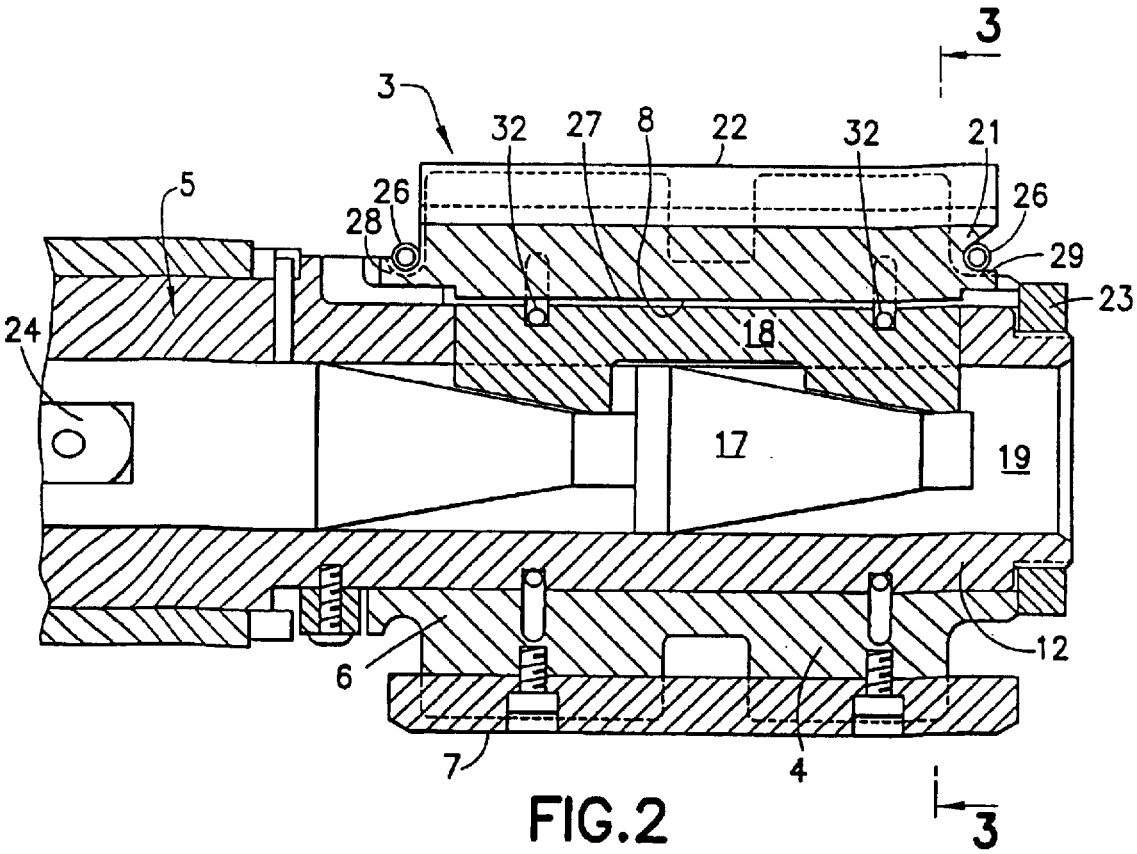
FIG.2 PRIOR ART
FIG. 2 is a cut away view of the mandrel and tool body assembly of FIG. 1 showing an example of the internal parts of an expander mechanism.
Figure 3:
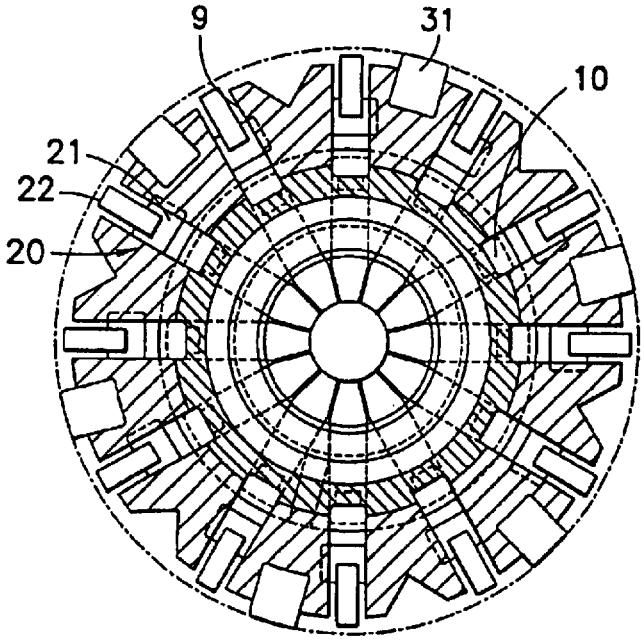
FIG.3 PRIOR ART
FIG. 3 is a sectional view of the mandrel and tool body assembly of FIG. 2 at section lines 3—3.

A tool mechanism generally representative of the art is shown in FIGS. 1–3 and is constructed for installation on spindle 1 of a honing machine. Such a tool is described in U.S. Pat. No. 5,957,766, which issued on Sep. 28, 1999 to an assignee common to this application. The disclosure of the '766 patent is incorporated herein by reference. The tool of the '766 patent is shown as an illustration of a tool of the type adaptable to this invention. The illustrated abrasive element expansion adjustment mechanism typifies the mechanics of a mechanism in general use. In this example, the tool body is removable from the mandrel, but there are limitations in the variety of replacement units in that the expansion mechanism remains attached to the mandrel. This design is advantageous in replacing worn abrasives, but not necessarily in converting to a different machining operation.

The illustrated tool consists of an elongated support shaft 2 which connects the machine spindle 1 to the tool. A mandrel 5 is a generally cylindrical element, attached to the distal end 3 of support shaft 2 which encloses an adjustment mechanism and other parts of the tool. Mandrel 5 is operatively connected to shaft 2 for rotation. A tool body 4 is mounted at the distal end 3 of the mandrel 5 and contains the abrasive elements 22.

As shown in FIGS. 1–3, tool body 4 is constructed as a shell having an outer periphery 7, an inner end 6, and an internal axial bore 8. Channels 9 are formed in the outer periphery 7 and extend axially to receive an abrasive assembly 20. The abrasive assembly 20 consists of a holder 21 and an abrasive block 22. The abrasive holder 21 is constructed with a bottom surface 27 for engagement with the expander element 18, described below. Holder 21 is held in place by elastic springs 26, as shown in FIG. 3. O-rings 26 engage U-shapeds 28 and 29 on either end of the holder 21. Additional channels 30 extend axially on the body 4 to receive guide members 31.

Elongated slots 10 are constructed at the base of the channel 9 which communicate with the internal bore 8 to provide access to the abrasive holder 21 from within. Inner end 6 contains a hexagonal recess to receive a mating drive surface on the mandrel 5 for transmission of drive torque from mandrel 5 to tool body 4.

The distal end 3 of mandrel 5 is shown in FIG. 1–3 and has cylindrical housing 12 sized to fit into the bore 8 of tool body 4. Housing 12 encloses the tip portion of the expander mechanism, identified by elements 17 and 18 shown in FIG. 3. The cam element 18 is held in place by elastic springs 32.

The housing 12, forms part of mandrel 5, and is constructed with an inner chamber 19 into which the expander mechanism extends. Housing 12 is constructed with slots 16 through which the expander element 18 extends for operative engagement with the bottom surface 27 of holder 21. This engagement is accomplished through the aligned slots 10 in tool body 4 and slots 16 in mandrel housing 12. The outer end of mandrel 5 has a threaded portion 25 to receive the threaded end cap 23 which serves to secure the tool body 4 on the mandrel 5.

As shown in FIGS. 1 and 2, the expander cam 17 is mounted at the tip end of an adjustment rod 24 which extends longitudinally within the support shaft 2 and connects with appropriate operating mechanisms within the spindle 1. The actuating rod 24, when actuated, pushes downward causing cam 17 to move radially outward. Cam 17 exerts a radial force on expander element 18 which is in contact with the surface 27 of holder 21. Axial movement of the adjustment rod 24 will, therefore, move the abrasive assembly 20 outward to compensate for wear.

The above description illustrates the general operation of an expansion mechanism used in many types of tools. The particular removable feature of the tool body 4 shown in FIGS. 1–3 of the illustrated tool is not instrumental to this invention, but the mandrel, tool body and adjustment mechanisms are operationally similar and equally adaptable to use in the apparatus of this invention.

In the prior art, adjustment rod 24 is mechanically connected to a control mechanism located in the machine spindle. The adjustment rod 24 may also be connected through a fluid medium to its actuation control. An adjustment mechanism using a fluid medium is described in copending Application for U.S. patent Ser. No. 10/193,767, filed on Jul. 10, 2002 and owned in common with the subject application. The disclosure of the referenced application is incorporated herein by reference.

Figure 4:
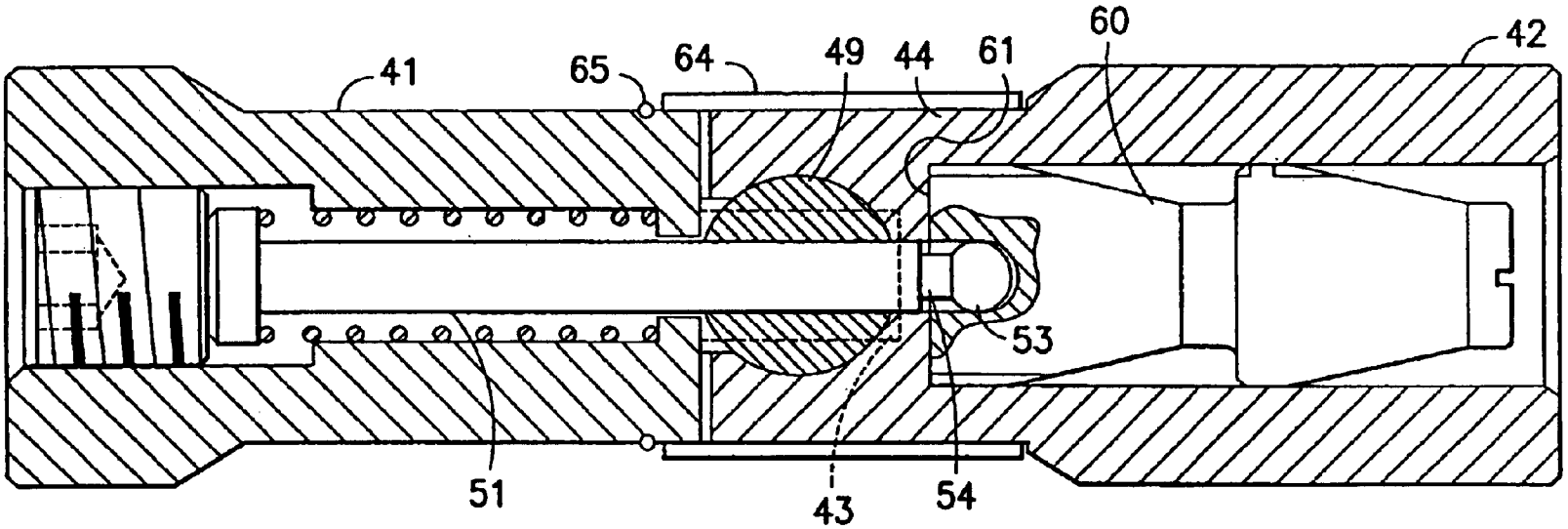
FIG. 4 is a sectional view of a detachable tool assembly employing the coupling of this invention.
Figure 5:
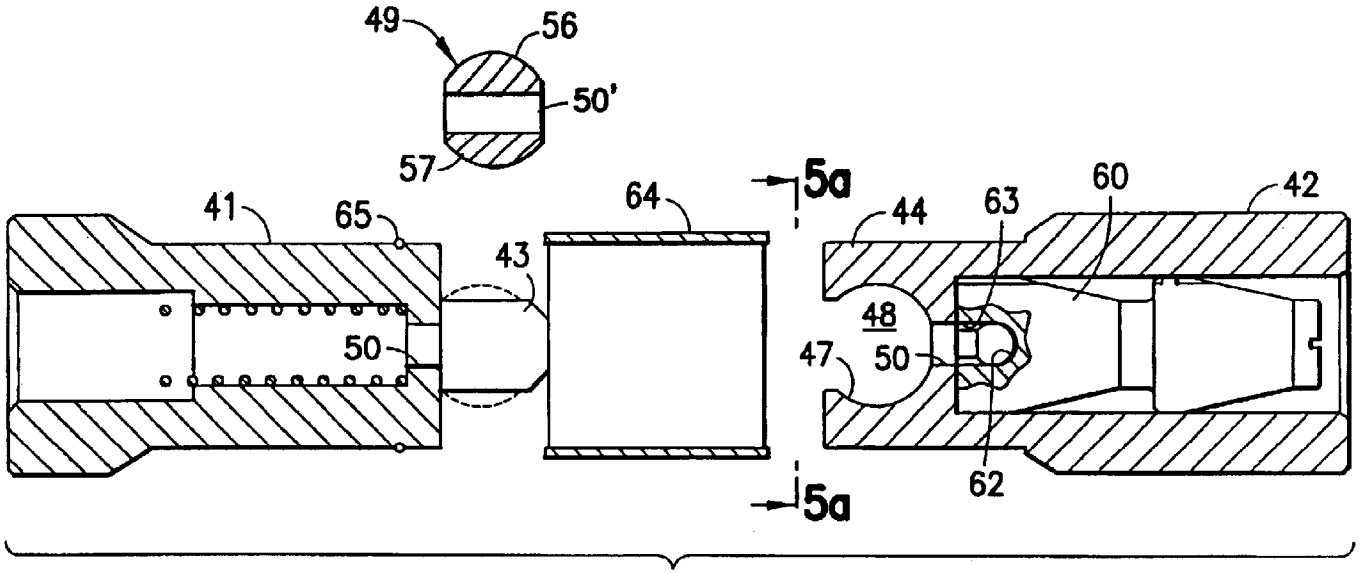
FIG. 5 is an axially exploded view of the tool assembly shown in FIG. 4.
Figure 5A:
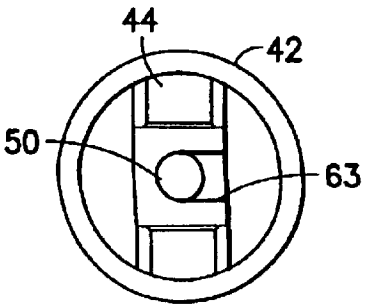
FIG. 5*a* is an end view (view lines 5*a*—5*a*) of the tool body of FIG. 4.
Figure 6:
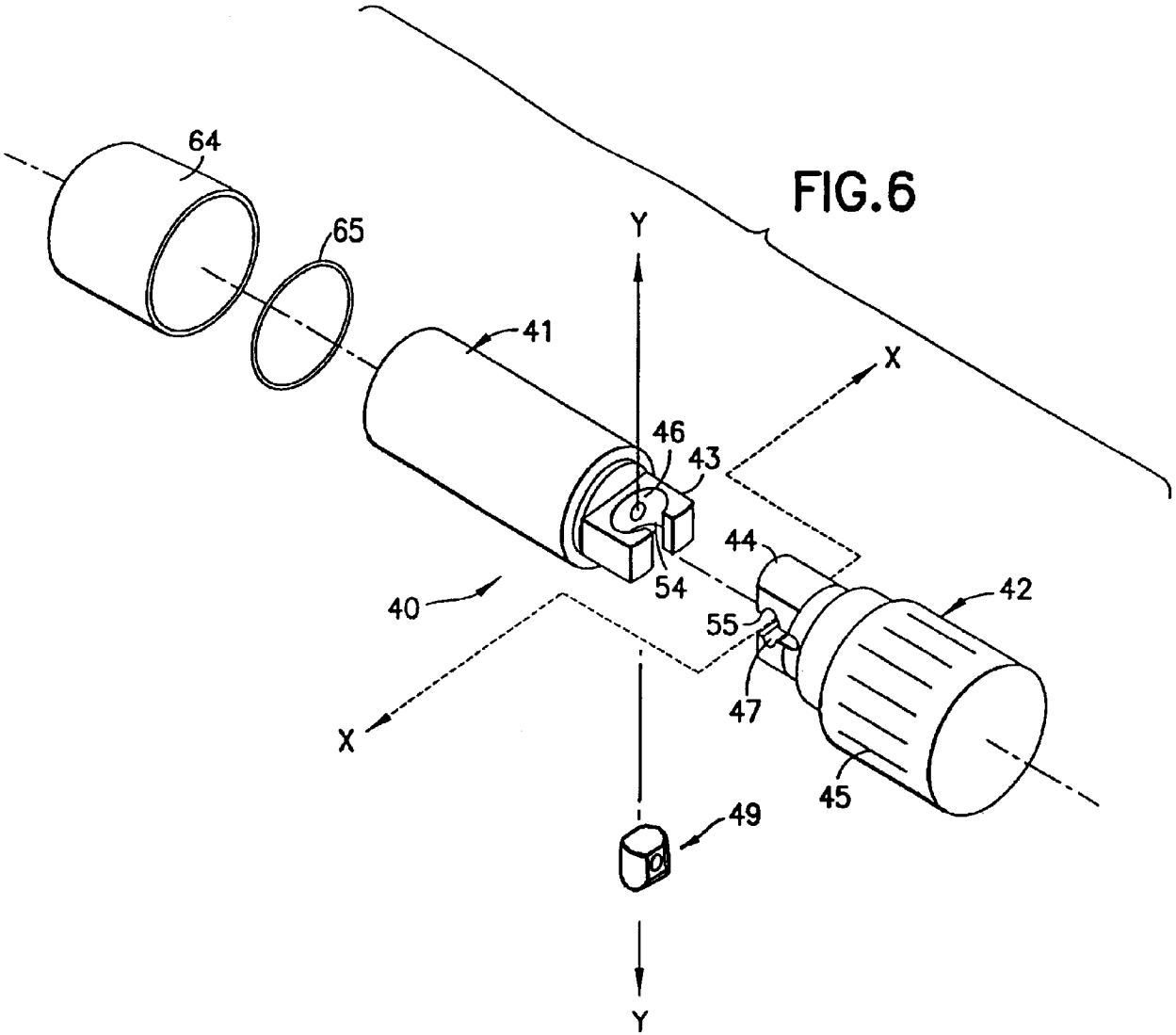
FIG. 6 is an exploded perspective view of the coupling of this invention.

The tool using the coupling of this invention is shown in FIGS. 4–7. The basic components of the coupling 40 are shown in FIGS. 4 and 6 and consist of drive shaft 41 which is operatively connected to the spindle of a CNC machine, such as shown in FIG. 1. Tool body 42 is coupled to drive shaft 41 by the engagement of opposing U-shaped elements 43 and 44 fixed to the ends of drive shaft 41 and tool body 42 respectively. Abrasive elements 45 are mounted for radial adjustment on tool body 42.

U-shaped elements 43 and 44 consist of mirror image shapes having a pair of arms which extend outward from a base formed on the respective parts. The inner surfaces 46 and 47 of the arms define inner receptacles 54 and 55 which are substantially cylindrical. Receptacle 54 of U-shaped element 43 is constructed having a curvature about the axis y-y while receptacle 55 of U-shaped element 44 is constructed having a curvature about the axis x—x, as shown in FIG. 6. When the U-shaped elements are assembled, a bearing seat 48 is formed by the cooperation of receptacles 54 and 55. The bearing seat 48, thus formed, has dual transverse axes of curvature.

Figure 7B:
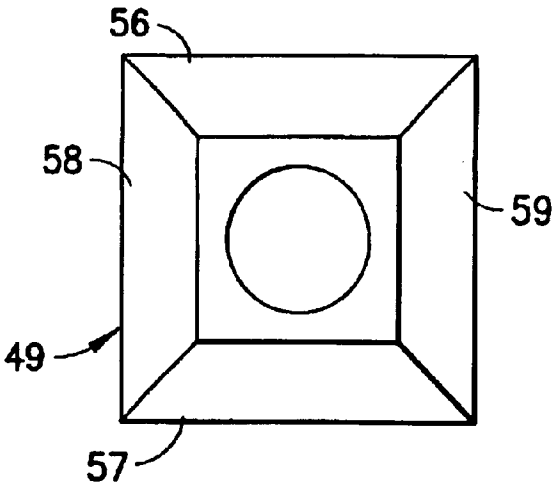
FIGS. 7*a*–7*c* are respectively side, front, and top views of the barrel element of this invention.
Figure 7C:
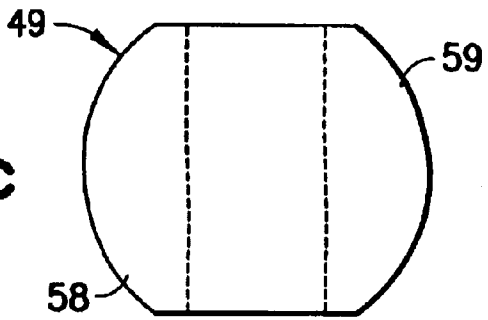
Figure 7A:
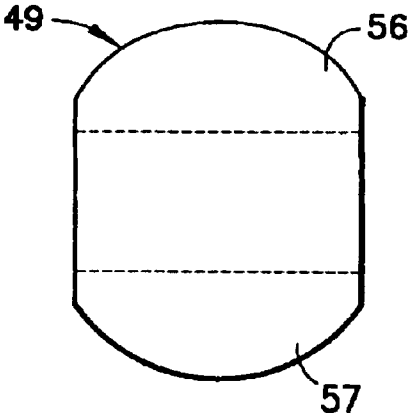

A barrel 49 provides a bearing element by which the U-shaped elements 43 and 44 are joined. Several views of barrel 49 are shown in FIGS. 7*a*–7*c*. The shape of barrel 49 is such as to be contained within the bearing seat 48. This requires that a top surface 56 and a bottom surface 57 have a common radius of curvature corresponding to receptacle 55 and side faces 58 and 59 have a common radius of curvature corresponding to receptacle 54. Barrel 49 is constructed with a central bore 50' which aligns with a similar axial bore 50 in drive shaft 41 and tool body 42 to allow the passage of adjustment rod 51.

In the assembled position, the inner surfaces 46 and 47 of U-shaped elements 43 and 44, therefore, define a bearing seat 48 having dual cylindrical curvatures about axes x and y. Barrel 49 is shaped with dual partial cylindrical surfaces 56–59 to engage each of the dual curvatures of seat 48. Barrel 49 can be slidably mounted within the inner surface 46 of U-shaped element 43 and in position, extends above and below the U-shaped element 43 for engagement with the inner surface 47 of U-shaped element 44, as shown in FIG. 5. To mount tool body 42 on the drive shaft 41, the tool body 42 is rotated so that the U-shaped element 44 is 90° out of phase with U-shaped element 43. Tool body 42 is then displaced transversely and aligned with the U-shaped element 43. U-shaped element 44 is then slid transversely into engagement with barrel 49. This coupling provides the tool body with freedom of motion about both of the axes x and y, while being locked against axial movement.

Drive shaft 41 and tool body 42 are constructed with an axial bore 50 to receive the adjustment rod 51. As shown in FIG. 4, adjustment rod 51 is an elongated element having a connection at its spindle end to the adjustment actuator of the machine spindle. Rod 51 extends through bore 50, bore 50', and the continuation of bore 50 in tool body 42. The tool end of rod 51 is constructed with a ball 53 fixed to rod 51 by a neck 54 of reduced diameter.

Adjustment cones 60 are mounted for axial movement in the tool body 42. To permit engagement with the ball 53 of rod 51, the connection end 61 of cones 60 is constructed with a slot 62 having a key hole shape of the general profile of neck 54 and ball 53. Slot 62 extends radially from an outer periphery of cones 60 inward past the center of the cross section of cones 60 and axially for a depth slightly less than the overall length of the ball and neck of rod 51. In addition a slot 63 is constructed in the U-shaped element 44 extending radially inward from its periphery to the bore 50. This permits the tool body 41 to slide transversely to the axis of the tool into engagement with adjustment cones 60 as it is being assembled with drive shaft 41.

A sleeve element 64 is mounted on the drive shaft 41 for axial movement over ring spring 65. After the drive shaft and tool body are engaged, the sleeve element 64 is moved axial to enclose the joint and secure the assembly from unintended detachment. Sleeve 64 is held in position by the friction engagement of ring spring 65.

We claim:

1. A coupling for releasably attaching a tool to a spindle of a machine for rotation about an axis thereof comprising:

a first U-shaped element attached to a drive member connected to said spindle, said first U-shaped element having a pair of arms extending outward therefrom in an axial direction, said pair of arms spaced apart radially on said first element to define a first receptacle between said arms, said first receptacle being defined by opposing surfaces of said arms, said surfaces having a first common curvature about a first axis transverse to the spindle axis;

a second U-shaped element attached to a tool supporting member, said U-shaped element having a pair of arms extending outward therefrom in an axial direction, opposing the arms of said first U-shaped element, said pair of arms spaced apart radially on said second element to define a second receptacle between said arms, said second receptacle being defined by opposing surfaces of said arms, said surfaces having a second common curvature about a second axis transverse to the spindle axis and said first axis;

a bearing element being shaped to fit in said first and second receptacles having external surfaces which mate with said first and second curvatures; and wherein said first and second U-shaped elements are assembled to form a seat by the cooperation of said first and second receptacles and said bearing element is secured in said seat and further wherein said first and second elements are locked from axial movement by engagement with said bearing element and said first and second U-shaped elements are allowed to rotate relatively about said first and second axes.

2. The coupling, according to claim 1, wherein said first and second U-shaped elements are mirror images of the each other.

3. The coupling according to claim 1, wherein said first and second U-shaped elements are detachable from each other.

4. A coupling for releasably attaching a tool to a spindle of a machine for rotation about an axis thereof comprising:

a first U-shaped element attached to a drive member connected to said spindle, said first U-shaped element having a pair of arms extending outward therefrom in an axial direction, said pair of arms spaced apart radially on said first element to define a first receptacle between said arms, said first receptacle being defined by opposing surfaces of said arms, said surfaces having a first common curvature about a first axis transverse to the spindle axis;

a second U-shaped element attached to a tool supporting member, said U-shaped element having a pair of arms extending outward therefrom in an axial direction, opposing the arms of said first U-shaped element, said pair of arms spaced apart radially on said second element to define a second receptacle between said arms, said second receptacle being defined by opposing surfaces of said arms, said surfaces having a second common curvature about a second axis transverse to the spindle axis and said first axis;

a bearing element being shaped to fit in said first and second receptacles having external surfaces which mate with said first and second curvatures;

wherein said first and second U-shaped elements are assembled to form a seat by the cooperation of said first and second receptacles and said bearing element is secured in said seat and further wherein said first and second elements are locked from axial movement by engagement with said bearing element and said first and second U-shaped elements are allowed to rotate relatively about said first and second axes and further comprising a sleeve mounted on said first U-shaped element for axial movement thereon between at least a first and second position, wherein, in said first position said sleeve covers the assembled first and second U-shaped elements and in said second position said sleeve allows the assembled first and second U-shaped elements to be uncoupled.

5. The coupling, according to claim 4, wherein said sleeve is secured in the cover position by frictional engagement with a ring spring.

6. A coupling for releasably attaching a tool to a spindle of a machine for rotation about an axis thereof comprising:

a first U-shaped element attached to a drive member connected to said spindle, said first U-shaped element having a pair of arms extending outward therefrom in an axial direction, said pair of arms spaced apart radially on said first element to define a first receptacle between said arms, said first receptacle being defined by opposing surfaces of said arms, said surfaces having a first common curvature about a first axis transverse to the spindle axis;

a second U-shaped element attached to a tool supporting member, said U-shaped element having a pair of arms extending outward therefrom in an axial direction, opposing the arms of said first U-shaped element, said pair of arms spaced apart radially on said second element to define a second receptacle between said arms, said second receptacle being defined by opposing surfaces of said arms, said surfaces having a second common curvature about a second axis transverse to the spindle axis and said first axis;

a bearing element being shaped to fit in said first and second receptacles having external surfaces which mate with said first and second curvatures;

wherein said first and second U-shaped elements are assembled to form a seat by the cooperation of said first and second receptacles and said bearing element is secured in said seat and further wherein said first and second elements are locked from axial movement by engagement with said bearing element and said first and second U-shaped elements are allowed to rotate relatively about said first and second axes; and further comprising:

abrasive elements mounted on the tool supporting member for radial movement to adjust the position thereof;

an adjustment mechanism engaging said abrasive elements to convert an axial motion to a radial motion of said abrasive elements; and an adjusting rod connected to said adjustment mechanism to cause axial movement thereof;

and wherein said adjusting rod extends through a bore formed in said coupling by aligned bore portions constructed in said first and second U-shaped elements and said bearing element.

7. The coupling, according to claim 6, wherein said first and second U-shaped elements are detachable from each other and said adjustment rod is detachable from the adjustment mechanism.

8. The coupling, according to claim 7, further comprising:

a first radially extending slot constructed in said second U-shaped element;

a second radially extending slot constructed in said adjustment means in alignment with said first slot;

a ball shaped extension constructed on said adjustment rod connected to said rod through a neck portion of reduced diameter; and wherein said first and second slots cooperate to allow the engagement of said ball shaped extension into said adjustment means by a sliding motion transverse to the axis of the tool.

* * * * *